US005706554A

United States Patent [19]

Rückert et al.

[11] Patent Number: 5,706,554

[45] Date of Patent: Jan. 13, 1998

[54] HANDLE FITTING, WHICH CAN BE INSERTED INTO AN OPENING IN A DOOR, PARTICULARLY A MOTOR-VEHICLE DOOR

[75] Inventors: Edvard Rückert, Velbert; Norbert Schmitz-Krüger, Essen, both of Germany

[73] Assignee: Ewald Witte GmbH & Co. KG, Velbert, Germany

[21] Appl. No.: 563,267

[22] Filed: Nov. 27, 1995

[30] Foreign Application Priority Data

| | | | |
|---|---|---|---|
| Dec. 2, 1994 | [DE] | Germany | 44 42 962.2 |
| Dec. 3, 1994 | [DE] | Germany | 44 43 117.1 |
| Dec. 19, 1994 | [DE] | Germany | 44 45 320.5 |

[51] Int. Cl.[6] ..... A47B 95/02

[52] U.S. Cl. ..... 16/112; 292/336.3

[58] Field of Search ..... 16/112, 114 R, 16/110 R, DIG. 24; 292/336.3, 347, DIG. 31; 70/237

[56] References Cited

U.S. PATENT DOCUMENTS

| | | | |
|---|---|---|---|
| 4,489,904 | 12/1984 | Soederberg | 292/DIG. 31 |
| 4,653,143 | 3/1987 | Ketelhut et al. | 292/336.3 |
| 4,889,373 | 12/1989 | Ward et al. | 292/336.3 |
| 4,898,415 | 2/1990 | Satoh | 293/DIG. 31 |
| 5,101,597 | 4/1992 | Pelachyk et al. | 16/110 R |
| 5,238,276 | 8/1993 | Burns | 292/347 |
| 5,282,657 | 2/1994 | Clinch et al. | 292/336.3 |
| 5,558,570 | 9/1996 | Nakamura et al. | 14/114 R |

*Primary Examiner*—Chuck Mah
*Attorney, Agent, or Firm*—Martin A. Farber

[57] ABSTRACT

A handle fitting (1) with displaceable actuating handle (10) which fitting can be inserted into an opening in a door (2), particularly the door of a motor vehicle, and fastened by means of a holding member (15). In order to fix the handle fitting in position exclusively from the outside of the door, the holding member (15) is movable into the holding position by displacement of the actuating handle (10)

20 Claims, 14 Drawing Sheets

HANDLE FITTING, WHICH CAN BE INSERTED INTO AN OPENING IN A DOOR, PARTICULARLY A MOTOR-VEHICLE DOOR

FIELD AND BACKGROUND OF THE INVENTION

The present invention relates to a handle fitting with displaceable actuating handle, which can be inserted into an opening in a door, particularly the door of a motor vehicle, and fastened by means of a holding member.

It is known to fasten handle fittings on the door of a motor vehicle in such a manner that these handle fittings can be inserted into the opening in the door from the outside of the door. The movement of insertion is in this case limited by the front plate of the handle fitting. The fastening of the handle fitting by means of a suitable holding member must then take place from the inner side of the door such a mounting is cumbersome from the standpoint of manufacture and accordingly leads to an increase in the cost of manufacture of a motor vehicle.

SUMMARY OF THE INVENTION

The object of the present invention is so to develop a handle fitting of the type in question in a manner which is simple to manufacture that the handle fitting can be fastened entirely from the outside of the door.

This object is achieved with a handle fitting of this type in the manner that the holding member can be moved into the holding position by displacement of the actuating handle.

As a result of the development of the invention, there is provided a fitting of this type the advantage of which resides essentially in the particularly simple mounting of the handle fitting. The mounting can be effected from the outside of the door without the use of any tool. The mounting steps are as follows: The handle fitting is inserted, as up to now, into the opening in the vehicle door after previously angling it until the front plate of the handle fitting rests against the outer surface of the door. The next mounting step consists merely in displacing the actuating handle, as when opening the door. With this movement of the actuating handle, the holding member is brought into the holding position and remains in this position, whereby the handle fitting already is imparted its final holding in place. No further measures are necessary. Therefore, the mounting can also take place even when the door inner lining has already been applied. Furthermore, one advantage resulting from the easy mounting is that the painted outer surface of the door is not damaged. Removal of the handle fitting can be effected only from the inner side of the door. For this purpose, there is present on the inner side of the door a tool introduction opening for moving the holding member back into the position of release so that the handle fitting can then be moved out of the opening in the door in the reverse manner. This process also can be effected within a short time and is advantageous, for instance, for the repainting of the door or of the vehicle. One version in accordance with invention is characterized by the fact that the holding member is developed as a slide which surrounds the rear surface of a handle trough of the handle fitting and is displaceable transverse to the axis of swing of the actuating handle. Upon the angling-in of the handle fitting, one end thereof comes into engagement behind the outer plate of the door and its other end passes by the displacement of the slide into the holding position in such a manner that then both ends of the slide then assume a position engaged behind the rear of the outer plate of the door and, accordingly, take up pulling forces acting on the handle fitting. As soon as the holding member or the slide has come into the holding position, it engages, securing the holding position. Even very substantial vibrations are not able to move the slide out of its holding position. This can be done only intentionally from the inner side of the door. The displacement of the slide into its holding position is effected by at least one projection on the actuating handle, which projection is rigidly connected with the swing shaft. If the slide assumes its holding position, the projection seated on the swing shaft always swigs idly along upon the displacement of the actuating handle. The handle fitting receives a firm seat in the manner that the ends of the slide rest under tension against the rear surface of the outer plate of the door. One possibility for obtaining the locking of the slide in its holding position consists in the slide having a central opening into which a slide-side tongue extends for cooperation with a detent projection having gable-type bevels present on the handle-trough side. This slide itself consists of spring material, as the tongue therefore also does. The detent position is obtained in the manner that the tongue moves over the vertex of the detent projection and, due to the corresponding gable bevel is continuously urged in the direction of the holding position. A variant of the development in accordance with the invention is characterized by the fact that the holding member is developed as a single-arm swing lever which rests against the rear surface of the handle trough of the handle fitting and engages with holding projections in the holding position behind the door outer plate on its rear side. This holding member which is developed as a swing lever is also moved into the holding position after insertion of the handle fitting upon the first actuation of the actuating handle and therefore cannot be pulled out of the opening in the door. In order that the swing lever is moved into the holding position upon the first actuation of the actuating handle, the swing lever forms a driver projection which is arranged opposite the holding projections and lies in the region of swing of a projection of the actuating handle on the inner side of the door. Also in this version, the case arises that, after displacement of the swing-lever-like holding member, the lever remains in its holding position. Accordingly, the driver projection also is in a position in which it is not longer grasped by the projection upon the displacement of the actuating handle. The side of the handle fitting opposite the holding projections is held due to the fact that an insertion slot formed between a front plate of the handle fitting and handle-trough-side extensions is present there. The opening-side edge region of the door outer plate enters into it and permits an angling-in of the handle fitting. Thereupon, upon the first actuation, the holding projections are brought into rear engagement or holding position with respect to the door plate. With this development, there is also the possibility of locking the holding member, namely the swing lever, in its holding position. The provision of arcuate slot guides for the swing lever has a stabilizing effect. The holding member can be of such a nature that it serves for holding the handle fitting and/or its lock cylinder fast. If both are fixed in position by the holding member, structural parts can be saved. Furthermore, the mounting of the lock cylinder is simplified. A particularly stable holding in position of the latter is obtained in the manner that the holding member enters into a blocking partial embracing of the lock cylinder.

In order that the holding member need not be a part of the handle fitting, it is proposed, in a further solution in accordance with the invention, that the holding member be supported in movable manner by the lock cylinder. The association with the handle fitting is such that, upon the first actuation of the actuating handle, the holding member, which is movably borne by the lock cylinder, comes into its held position and, accordingly, in addition to the lock cylinder, also locks the handle fitting on the door. A removal of the handle fitting from the outside of the closed door is therefore not possible. After effecting the first actuation of the actuating handle, no further displacement of the holding member is effected by the latter. For example, the mounting of the handle fitting with lock cylinder can take place in the manner that first of all a bearing bracket is inserted through the opening in the door. The actuating handle is then to be inserted. Thereupon, the holding member is inserted together with the lock cylinder into the handle fitting in such a manner that the holding member extends within the region of movement of the displacement projection of the actuating handle. If the latter now experiences its first displacement, the holding member is acted on via the displacement projection and thereby passes into its held position and accordingly fixes the lock cylinder as well as the handle fitting in position. In detail, this takes place in the manner that the holding member seated on the lock cylinder is pushed through an opening in the handle fitting/door outer plate, upon insertion of the lock cylinder. Upon the following displacement of the holding member, the latter is then no longer aligned with the opening in the handle fitting/door outer plate and accordingly makes the pulling out of the lock cylinder impossible. In the held position of the holding member, the lateral projections of the latter rest against shoulders of the handle fitting, so that the latter is thereby locked. The tongue of the holding member which moves away resiliently engages, in this position of the holding member displaced by the actuating handle, behind a locking step of the handle fitting and prevents an unintended rearward displacement of the holding member. The latter must be intentionally effected from a tool insertion opening which is provided on the inner side of the door. This tool can, for instance, be a screwdriver which is inserted through the insertion opening and then permits the disengagement of the tongue in the manner that the tongue is pushed past the locking step. In principle, however, the use of a tool requires the open position of the door. With the door closed, no tool can be introduced in order to bend the tongue out of its detent position. With respect to the holding member, it can be a displaceable or else swingable part. However, it must be so developed that upon the first actuation of the actuating handle, it is grasped and brought into a position of rear engagement, fixing the lock cylinder as well as the handle fitting to the door.

BRIEF DESCRIPTION OF THE DRAWINGS

With the above and other objects and other advantages in view, the present invention will become more clearly understood in connection with the detailed description of preferred embodiments, when considered with the accompanying drawings of which.

DETAILED DESCRIPTION OF THE PREFERRED EMBODIMENTS

Figure 1:
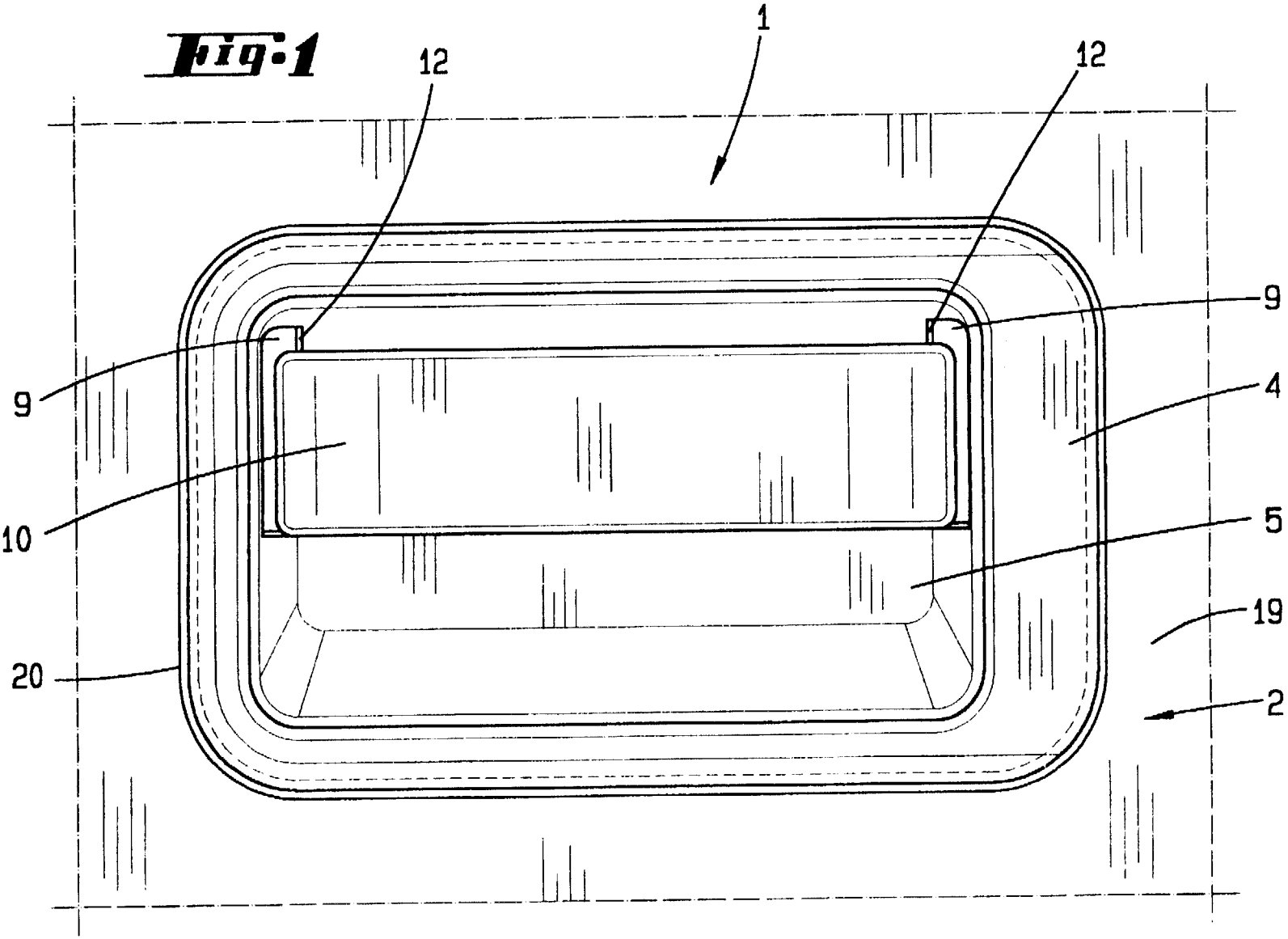
FIG. 1 shows the handle fitting in accordance with the first embodiment, associated with the vehicle door, seen in front view.

In accordance with the first embodiment, shown in FIGS. 1 to 6, a handle fitting 1 is associated with a motor vehicle door 2. The latter has an approximately rectangularly shaped opening 3 which is smaller than a handle-fitting front plate 4 which continues at the rear into a tub-shaped handle trough 5.

On the upper region of the handle trough 5, there are developed two bearing brackets 6 extending parallel to each other which support a swing shaft 7. The ends thereof protrude beyond the bearing brackets 6 and bear there, firmly attached to the swing shaft 7, angle arms 8 which pass through slots 9 in the handle trough 2 and bear, on the inside of the trough, an actuating handle 10 which connects the two angle arms 8. Between the bearing brackets 6 and the angle arms 8 the ends of the swing shaft 7 bear torsion springs 11 which urge the actuating handle in the inward direction of the handle trough 5. The inward displacement is limited by end edges 12, extending into the handle trough 5, of channels 13 which are arranged parallel to each other and form the slots 9 for the passage of the angle arms 8.

Figure 2:
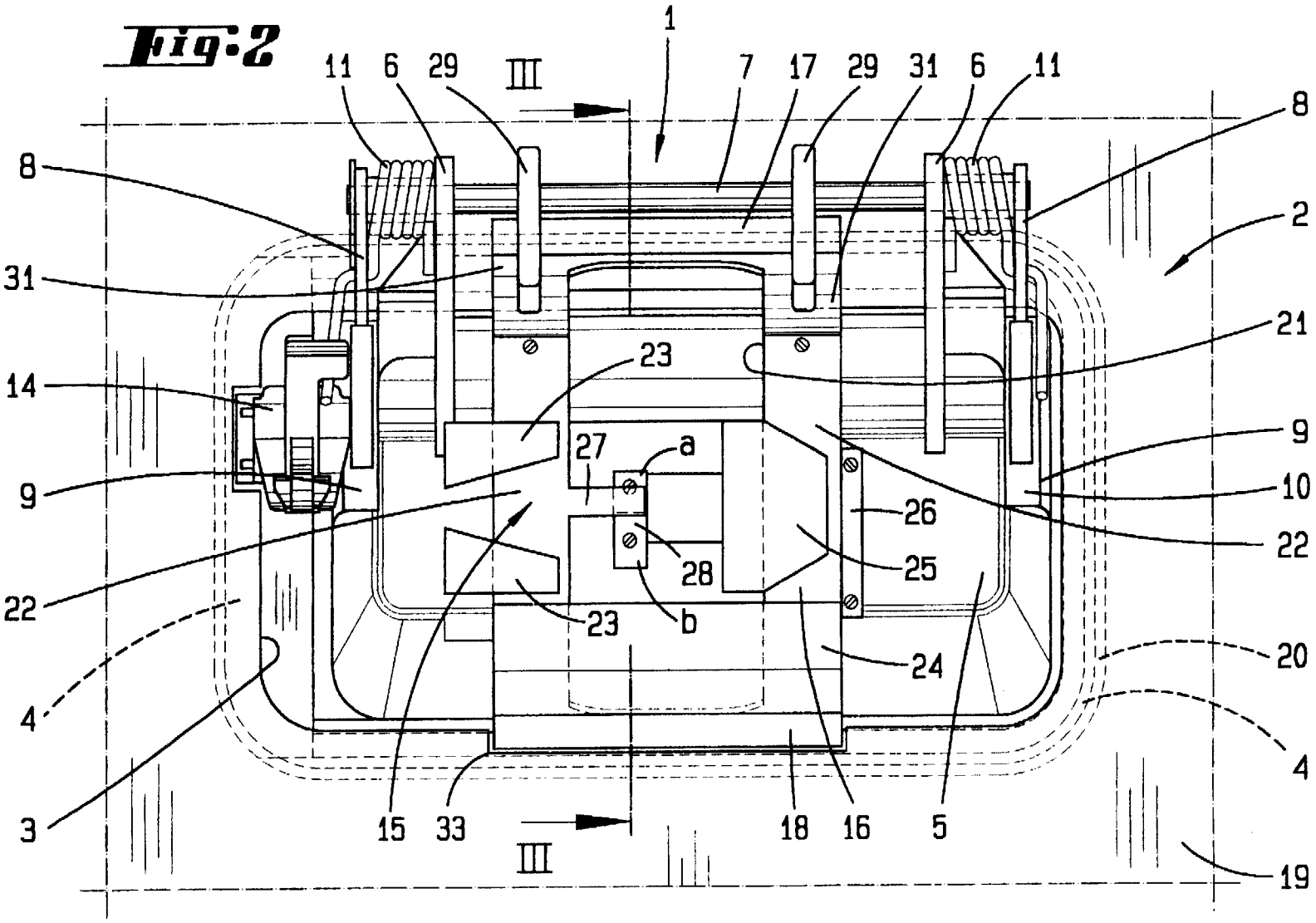
FIG. 2 is a rear view of the handle fitting inserted into the opening in the vehicle door with the holding member developed as slide, shown in release position.
Figure 6:
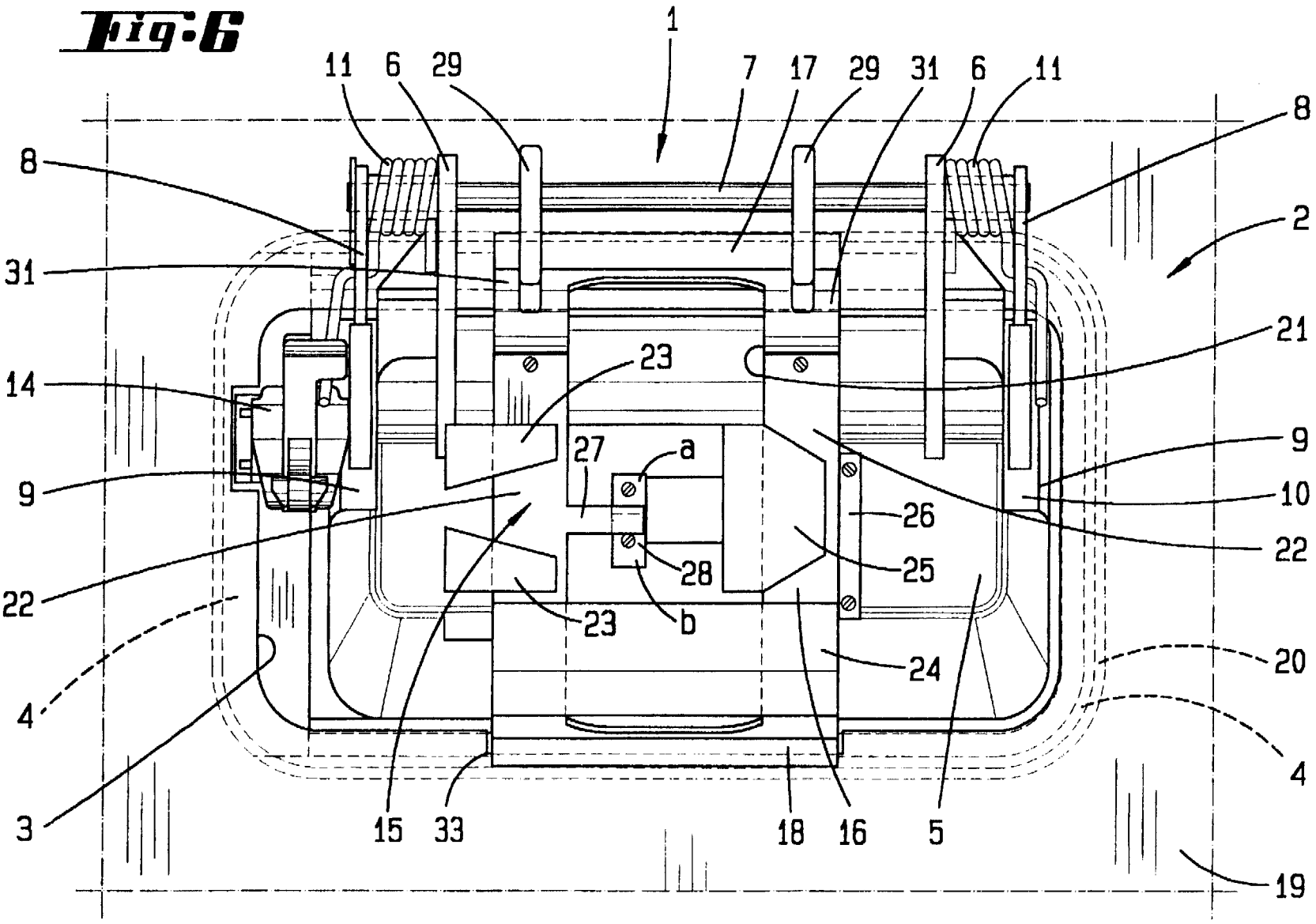
FIG. 6 is a rear view corresponding to FIG. 2, with the holding member brought into the holding position.

The angle arm 8 arranged to the left in FIGS. 2 and 6 is coupled in known manner to a swing member 14 of a door closure mechanism, not shown. This swing member 14 is acted on by the corresponding torsion spring 11.

A holding member 15 serves for the holding of the inserted position of the handle fitting 1. This member is developed, in accordance with the first embodiment, as a slide 16 surrounding the rear surface of the handle trough 5 and displaceable transversely to the swing shaft 7. As seen in vertical section, the slide 16 has an approximately U-shape. The ends 17, 18 which are bent-off from the U legs extend approximately parallel to the front plate 4 of the handle fitting and form insertion slots E the width of which is less than the thickness of the door outer plate 19 of the motor vehicle door 2. Furthermore, the handle-fitting front plate 4 receives on the rear a sealing collar 20 consisting of flexible material.

The slide 16 which consists of steel having spring properties forms a central opening 21. In this way, there are produced vertically extending frame webs 22 with which there are associated guide members 23, 24, 25 and 26 extending of the rear of the handle trough 5. While the guide members 23, 24, 25 extend over the frame webs on the rear, the guide member 26 forms solely a lateral support for the frame web 22 associated with it. In the region between the guide members 23, a tongue 27 which extends into the central opening 21 is developed on the corresponding frame web 22. This tongue cooperates with a detent projection 28 on the handle-trough side, which forms gable bevels a and b. Before the installing of the handle fitting 1, the tongue 27 extends at the height of the gable bevel a.

The swing shaft 7 bears two projections 29 which are arranged parallel to each other. Each of these projections 29 forms a rounded actuating surface 30 which, when the slide 16 is in the release position, extends up to the rounded transition zone 31 between U-web and upper U-leg. A support web 32 integral with and extending rearward from the handle-fitting front plate 4 is associated with the lower, bent end 18 of the slide 16, the horizontal length of said support web 32 corresponding approximately to that of the slide 16. For this support web 32, the opening 3 is provided with a recess 33.

Figure 5:
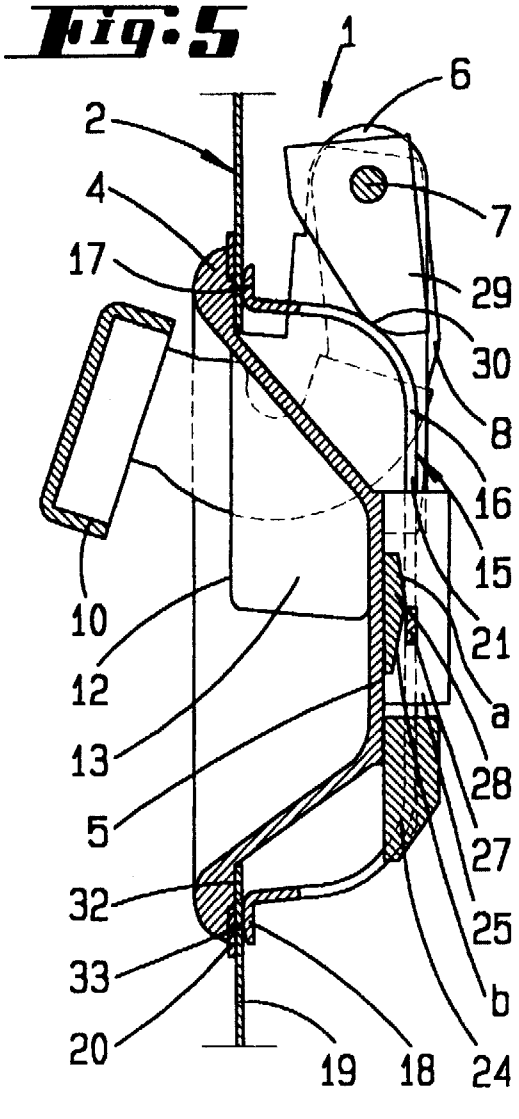
FIG. 5 is a showing after FIG. 4, in which, by displacement of the actuating handle due to cam control, the slide is moved into its holding position.
Figure 4:
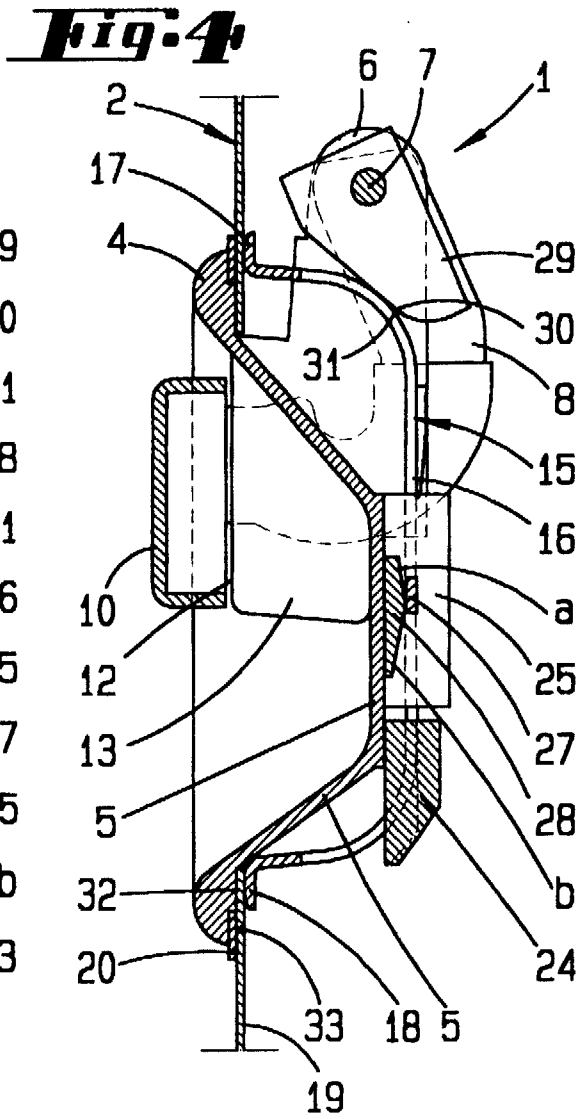
FIG. 4 is a section corresponding to FIG. 3, in which, differing from the latter, the handle fitting has been angled-in and brought into the supporting position, with the holding member assuming the release position.
Figure 3:
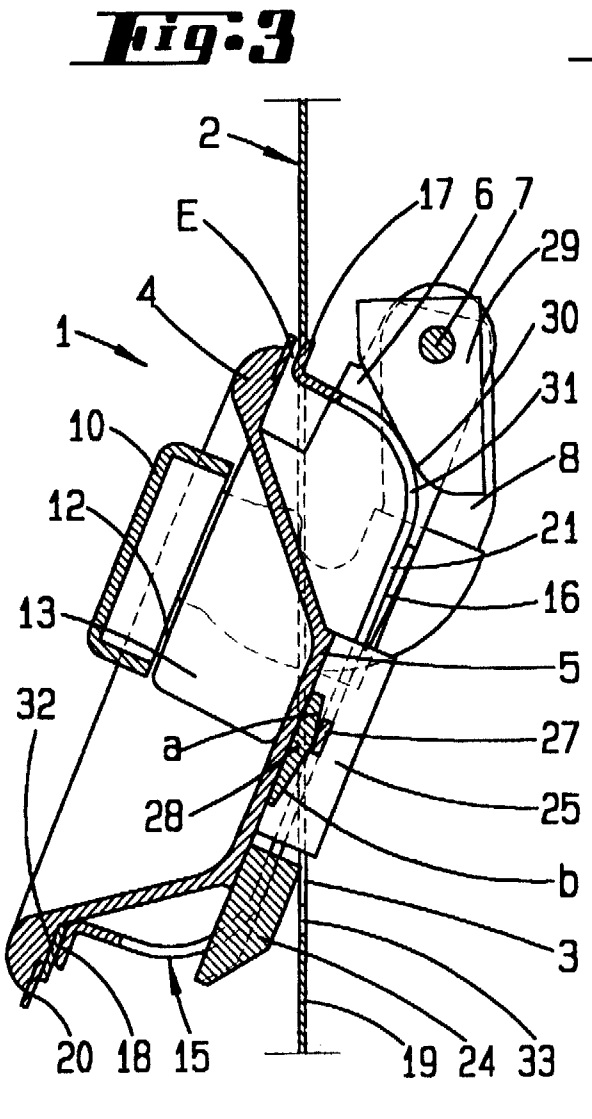
FIG. 3 is a section along the line III—III, but during the angling-in of the handle fitting.

The handle fitting 1 is mounted in the following manner:

Before the insertion of the handle fitting, the slide 16 and the holding member 15 are in the position shown in FIGS. 2, 3 and 4. The handle fitting can now be angled-in, in which connection, after partial swinging of the handle trough 5 into the opening 3, the upper edge of the opening enters into the insertion slot E between the end 17 of the slide 16 and the upper region of the front plate of the handle fitting; see FIG. 3. Thereupon, the handle trough 5 can be swung in completely. The swinging-in is limited by the handle-fitting front plate 4 or the sealing collar 20 thereof, which rests on the outer surface of the door 2 of the motor vehicle. During this swinging-in movement, the support web 32 has also entered into the recess 33 associated with it; see FIG. 4. The next mounting step consists in extending the fingers of the actuating hand behind the actuating handle 10 and swinging it while holding the hardware fitting 1 in its inserted position, in which connection the slide 16 is shifted into its holding position in downward direction via the projections 29 which are rigidly attached to the swing shaft 7, and in which connection a lower end 18 of the slide 16, after passing over the support web 32, comes into position overlapping the door outer plate 19 of the door 2 and thereby assumes its holding position. The engagement of the upper end 17 of the slide behind the door outer plate is not eliminated by this, so that both ends of the slide assume the position engaged behind the door outer plate 19, as shown in FIGS. 5 and 6. If the actuating handle 10 is released, the handle moves under spring action back into its starting position, shown in FIG. 4. The handle fitting is held fast and no further mounting steps are required. Upon the following actuations of the handle, the projections 29 are swung. However, they do not exert any influence any longer on the slide 16.

The removal of the handle fitting can be effected only from the inner side of the door. Through a tool insertion opening (not shown) on the inner side of the door 2, the slide 16 can, by action on it, be displaced out of its holding position into the position of release, the end 18 traveling onto the support web 32.

Figure 7:
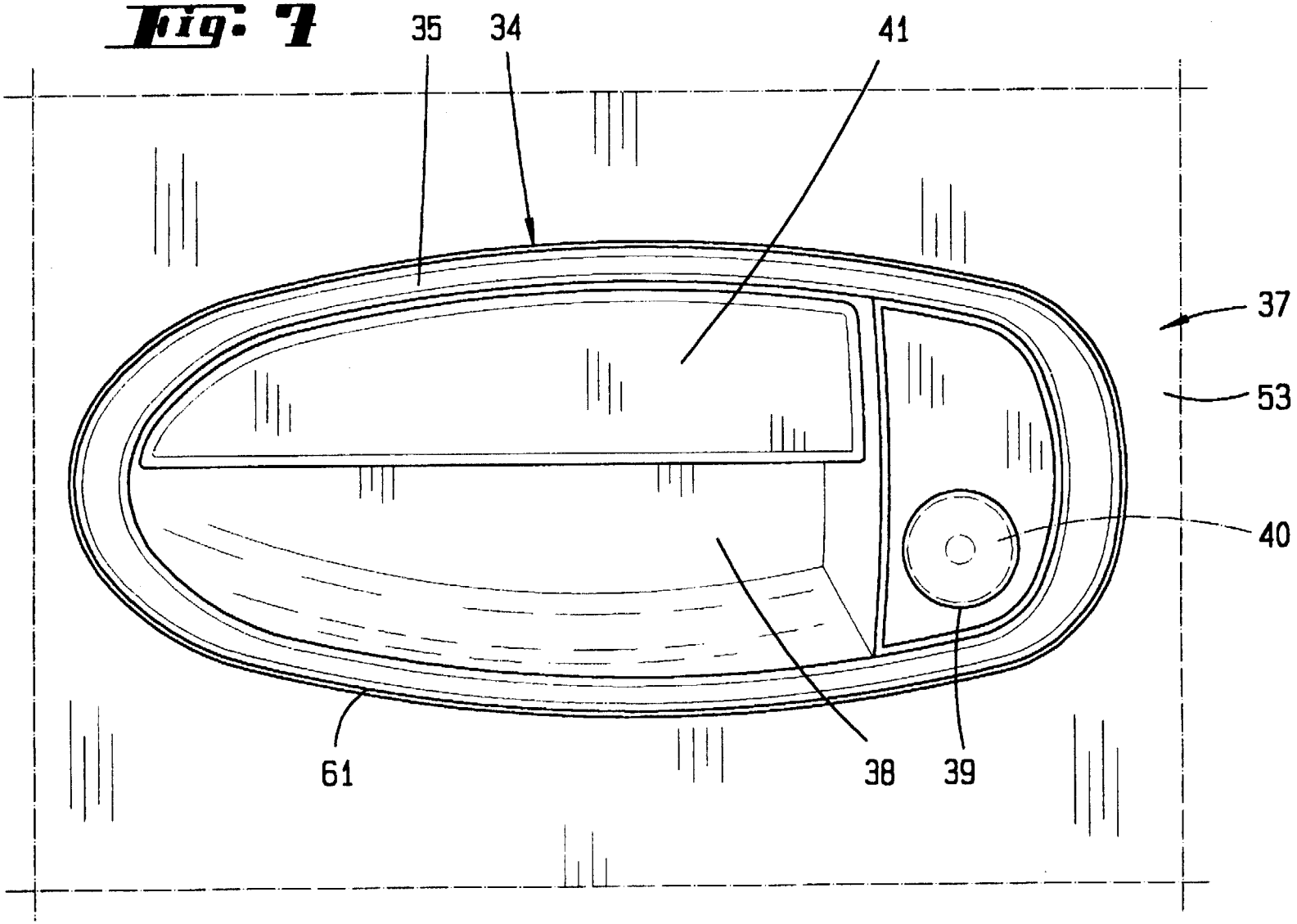
FIG. 7 is a front view of a differently developed handle fitting in accordance with the second embodiment, associated with a motor vehicle door.

In accordance with the second embodiment, shown in FIGS. 7 to 14, the handle fitting 34 has an elongated contour in horizontal direction. From the front plate of the handle fitting 35, which extends over the edge of an opening 36 in a door 37 of a motor vehicle, a handle trough 38 extends directed towards the inner side of the door. The trough does not extend over the entire contour of the handle fitting but, as shown in FIG. 7, leaves, on the right-hand side, a space having an insertion opening 39 for a lock cylinder 40, shown in dashed line. Within the handle mold 38, in its upper region, there is an actuating handle 41 which, in its turn, is seated on two angle arms 42 arranged parallel to each other. They are passed through by a shaft 43 which, in its turn, rests non-rotatably in bearing brackets 44 which extend from the handle trough 38 with which they are integral. In each case, one bearing bracket 44 is adjacent to each angle arm 42 on its outer side. In the region between the angle arms 42, the shaft 43 bears a torsion spring 45. The one end 45' of the spring rests on the rear of the handle trough 38, while the other end 45" acts on the one angle arm 42 and thus swings the actuating lever 41 into a position in which its front side is aligned with the front plate of the handle fitting. This position is also stop-limited by corresponding means, not shown in detail.

Figure 8:
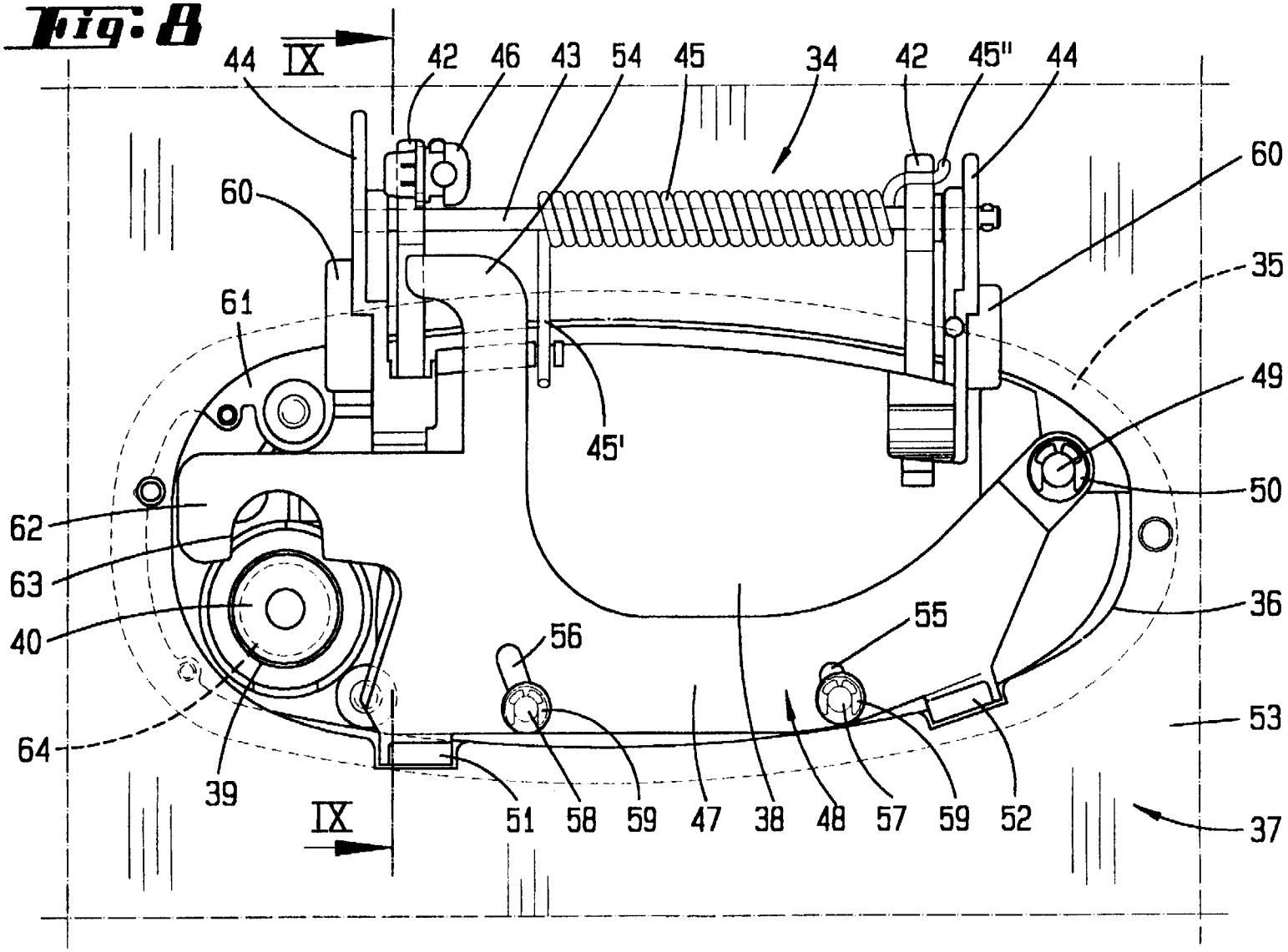
FIG. 8 is a rear view of this handle fitting, the holding member being in its release position.
Figure 12:
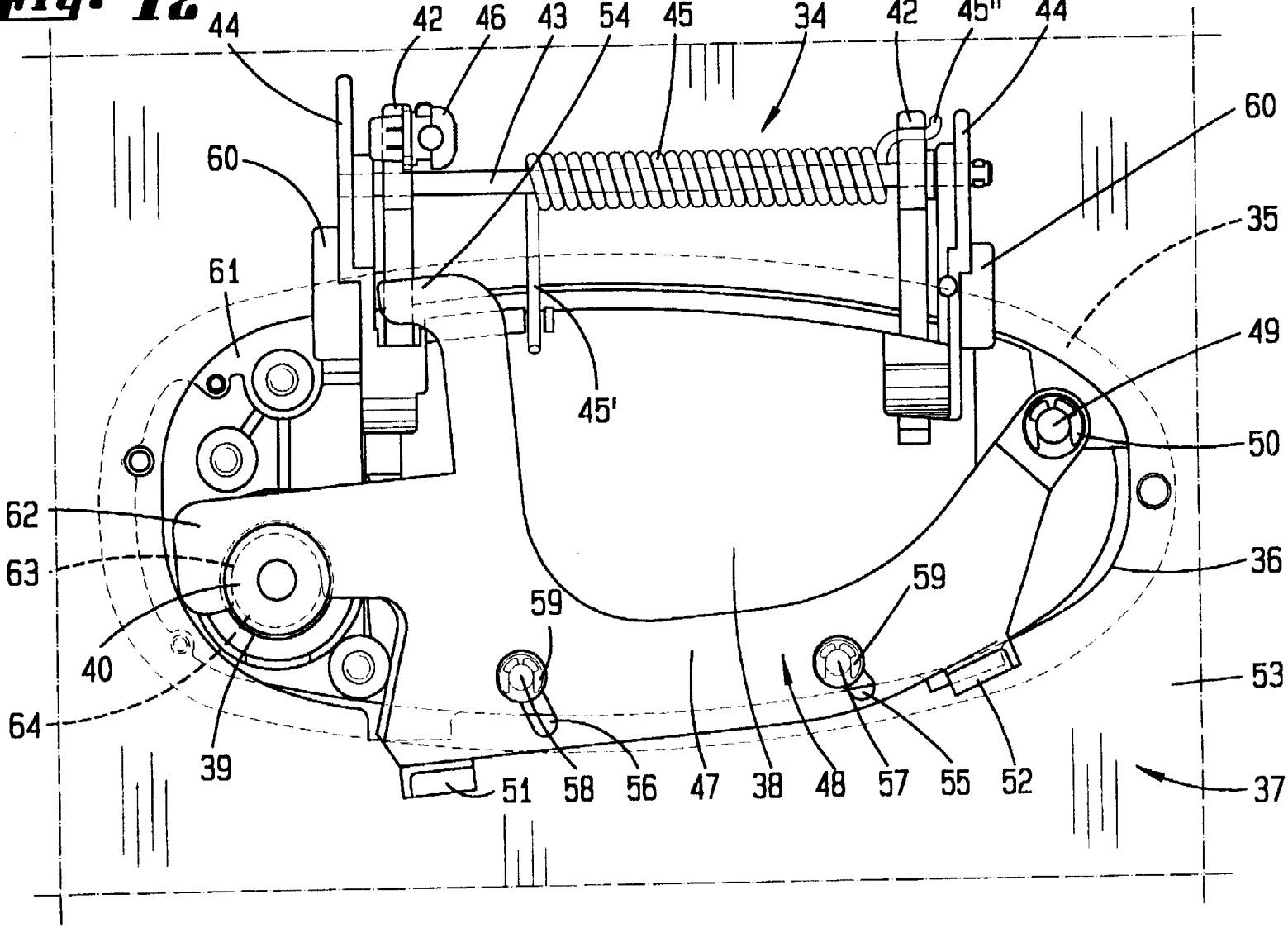
FIG. 12 is a rear view of the handle fitting with its holding member assuming the holding position.
Figure 14:
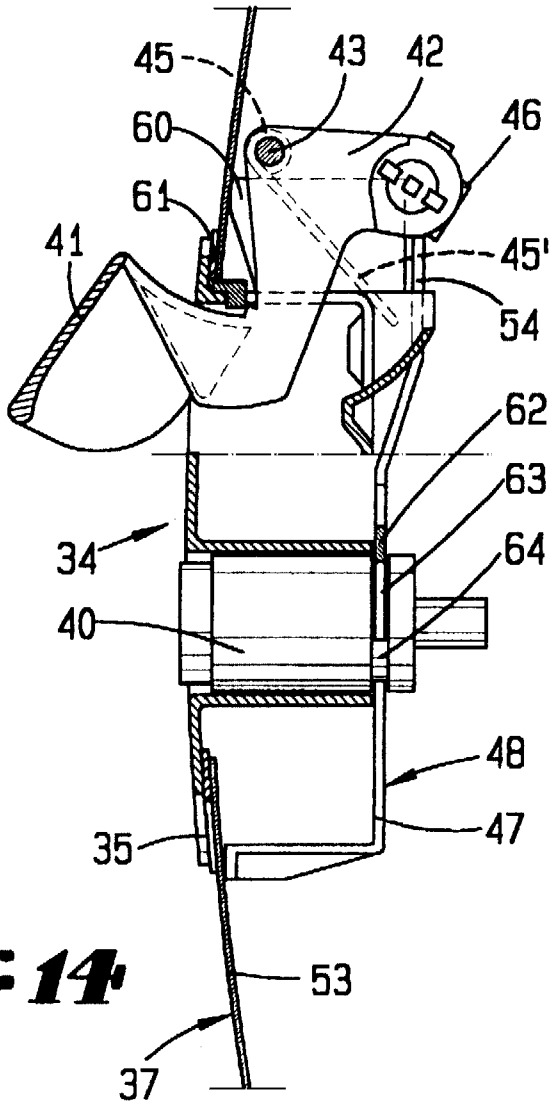
FIG. 14 shows the position after FIG. 13, in which the lock cylinder is also held by the holding member.
Figure 13:
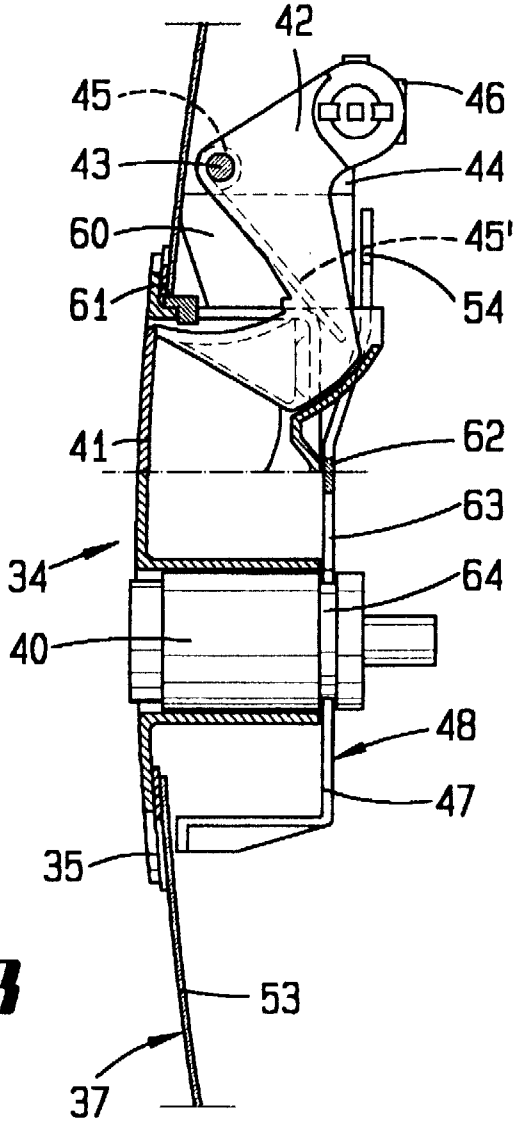
FIG. 13 is a section similar to FIG. 10, through the handle fitting, in which, differing therefrom, the lock cylinder is also included in the sectional showing.

The angle arm 42, which in accordance with FIGS. 8 and 12 is arranged on the left-hand side of the handle fitting 34, bears a connecting member 46 for the door-closure mechanism (not shown).

On the rear of the handle trough 38, there extends a holding member 48 developed in the form of a swing lever 47. This holding member lies with its surface against the rear of the handle trough 38 and is developed as a one-arm lever. The bearing is located on the end of the handle fitting 34 opposite the insertion opening 34. There a pivot pin 49 extends from the rear of the handle-fitting front plate 35, the pin fixing in place the bearing-side end of the swing lever 47 by means of a circlip 50. From the approximately horizontally extending lower side the swing lever 47, there arise two holding projections 51, 52 arranged spaced apart from each other which, when the holding member 43 is in the release position, lie within the opening 36 in the door outer plate 53.

Opposite the holding projection 51, the swing lever 47 forms a driver projection 54. In the release position of the holding member 48, said projection 54 extends over the upper edge region of handle-fitting front plate 35 and extends within the region of swing of the connecting member 46. Furthermore, the swing lever 47 is provided with arcuate slots 55, 56 which are concentric to the pivot pin 49. Into these slots there engage trough-side guide pins 57 and 58 respectively. Circlips 59 surround the outer side the swing member 47 and secure the position thereof. In this connection a friction lock can be produced in the movement of the swing lever 47 so that the latter can only be shifted intentionally. A detent locking of the swing lever 47 in its two end positions would also be possible.

The bearing brackets 44 are flanked by extension arms 60 which are firmly attached to them. Said extension arms leave an insertion slot E' between themselves and the handle-fitting front plate 35 or a sealing collar 61 present there, said insertion slot being of somewhat smaller width than the thickness of the outer plate 53 of the door.

In the region between the driver projection and the holding projection, the holding member continues into a fork-shaped arm 62. A fork jaw 63 present therein cooperates with an annular groove 64 in the lock cylinder 40.

Figures 9, 10, 11:
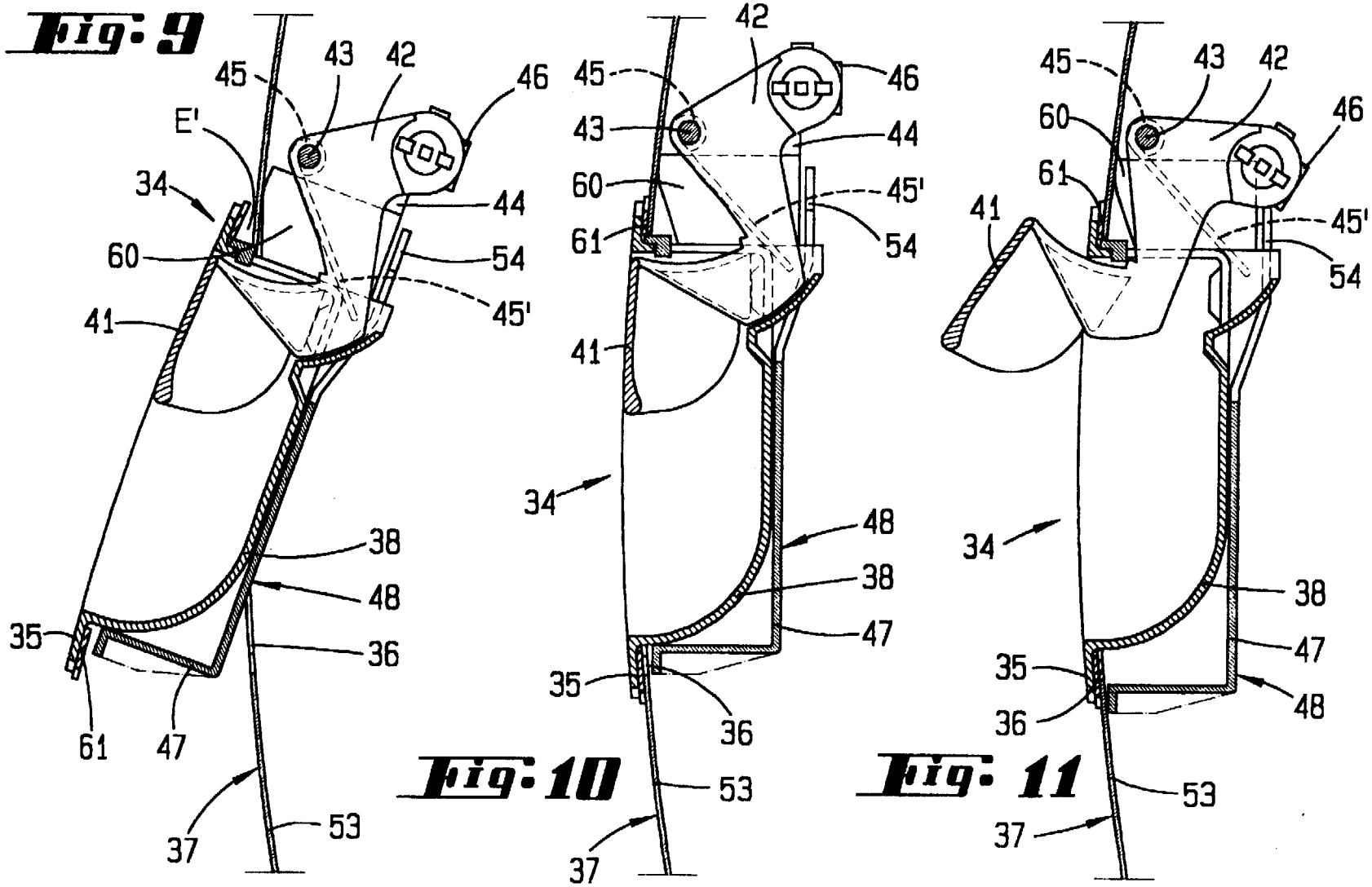
FIG. 9 is a cross section through the handle fitting during the angling thereof into the opening in the door of the motor vehicle.
FIG. 10 is the position after FIG. 9, in which the handle fitting has been completely inserted into the opening until limited by the stop.
FIG. 11 is a section corresponding to FIG. 10, with actuating handle displaced and holding member or swing lever brought into the holding position.

The mounting of this handle fitting which has been described above is effected as follows: Before the installing of the handle fitting 34, the holding member 48 or swing lever 47 is swung into the position shown in FIG. 8. The fork jaw 63 of the arm 62 extends in this connection outside the contour of the lock-cylinder insertion opening 39. This is followed by the angling-in of the handle fitting as shown in FIG. 9, the upper edge region of the opening 36 entering into the insertion slot E'. The handle fitting 34 can now be swung into the opening 36 around the upper bearing place formed thereby, reaching the position shown in FIGS. 8, 10 and 13. The holding projections 51, 52 then extend on the inner side of the outer plate 53 of the door. If the lock cylinder 40 has not yet been inserted, this is now done. The fork jaw 63 is thereby in interception position in front of the annular groove 64 of the lock cylinder 40. While holding the handle fitting 34 fast in this position, the actuating handle 41 can now be swung into the position shown in FIG. 11. Upon this process, the connecting member 46 which forms a projection strikes against the driver projection 51 of the swing lever 47 and moves it around its pivot pin 49, while at the same time the holding projections 51, 52 enter into engagement behind the lower edge of the opening 36 of the door outer plate 53; see FIGS. 11 and 12. At the same time, the arm 62 of the holding member 48 has shifted, producing a form-lock between fork jaw 63 and annular groove 64 of the lock cylinder 40, so that the latter is fixed in its installed position. The position of the holding member 48 can possibly be secured by detent. The pulling-out of the handle fitting 34 from the opening 36 is then not possible. Upon the further displacements of the actuating handle, the driver projection 54 of the swing lever 47 is no longer contacted.

The removal of the handle fitting 34 can be effected in the case of this version also only from the inner side of the door. A tool-insertion opening is also arranged on the inner side of the door in order to move the holding member 48 or swing lever 47 back into the corresponding position of release, the holding projections 51, 52 emerging from the holding position or engagement behind the door outer plate 53.

Modifications of the embodiments described are possible, for instance in the manner that the guiding of the holding member into the holding position takes place via differently shaped structural parts, but in such a manner that upon the first displacement of the actuating handle after the insertion of the handle fitting, the holding member is brought into the holding position.

Figures 15, 16, 17:
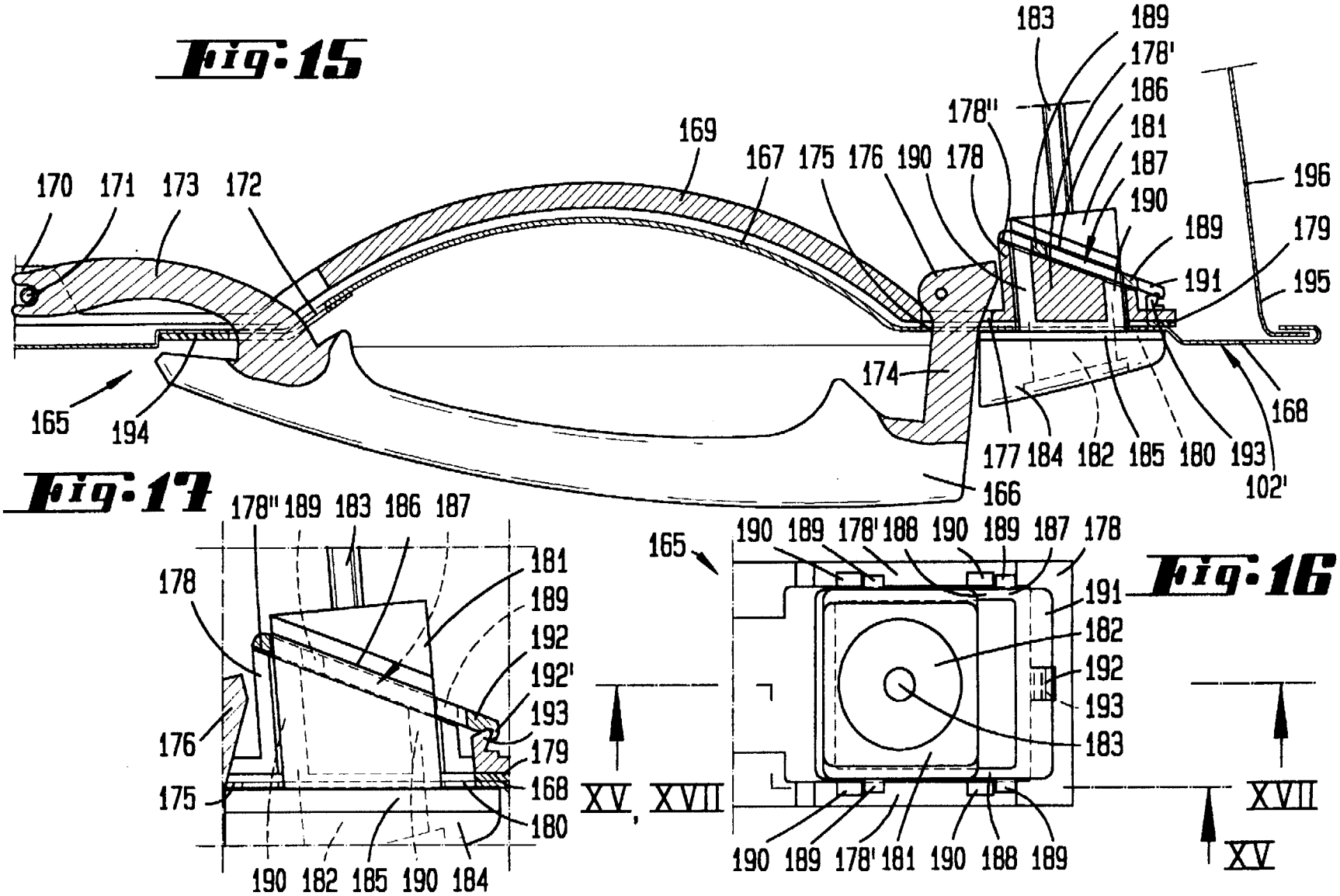
FIG. 15 is a longitudinal section through a handle fitting provided with a lock cylinder along the line XV—XV of FIG. 16, referring to the third embodiment.
FIG. 16 is a rear view of the handle fitting, looking at the lock cylinder.
FIG. 17 is a section along the line XVII—XVII of FIG. 16.

In accordance with the third embodiment, shown in FIGS. 15 to 22, 165 designates a handle fitting which is associated with the door 102' of a motor vehicle. An actuating handle 166 which in horizontal direction extends over a handle trough 167 of the door outer plate 168, the trough being bent towards the inside of the door, is part thereof. A bearing cap 169 on the inner side of the door is adapted to the shape of the handle trough 167. The end of said cap extending to the left in accordance with FIG. 15 is developed as a bearing bracket 170. The pivot pin 171 borne by it serves as swing pin for the fork-shaped end section 173 of the actuating handle 166 which extends through an opening 172 in the outer plate 168 of the door. The end of the actuating handle 166 opposite the end section 173 continues in a bend 174 extending in the direction of the door 102' with an enlarged head 176 which extends through an opening 175 and also passes through a recess 177 in the bearing cap 169.

On the other side of the recess 177, the bearing cap 169 forms a frame-shaped housing 178. The latter extends on the inner side of the outer plate 168 of the door. Between the housing 178 and the door outer plate 168 there is a packing 177, shown diagrammatically. The bearing cap 169 is inserted together with the housing 178 through a door recess 180 in the door outer plate 168 in such a manner that the end section opposite the bearing bracket 170 extends over the door outer plate 168 on the other side of the door recess 180.

Figure 19:
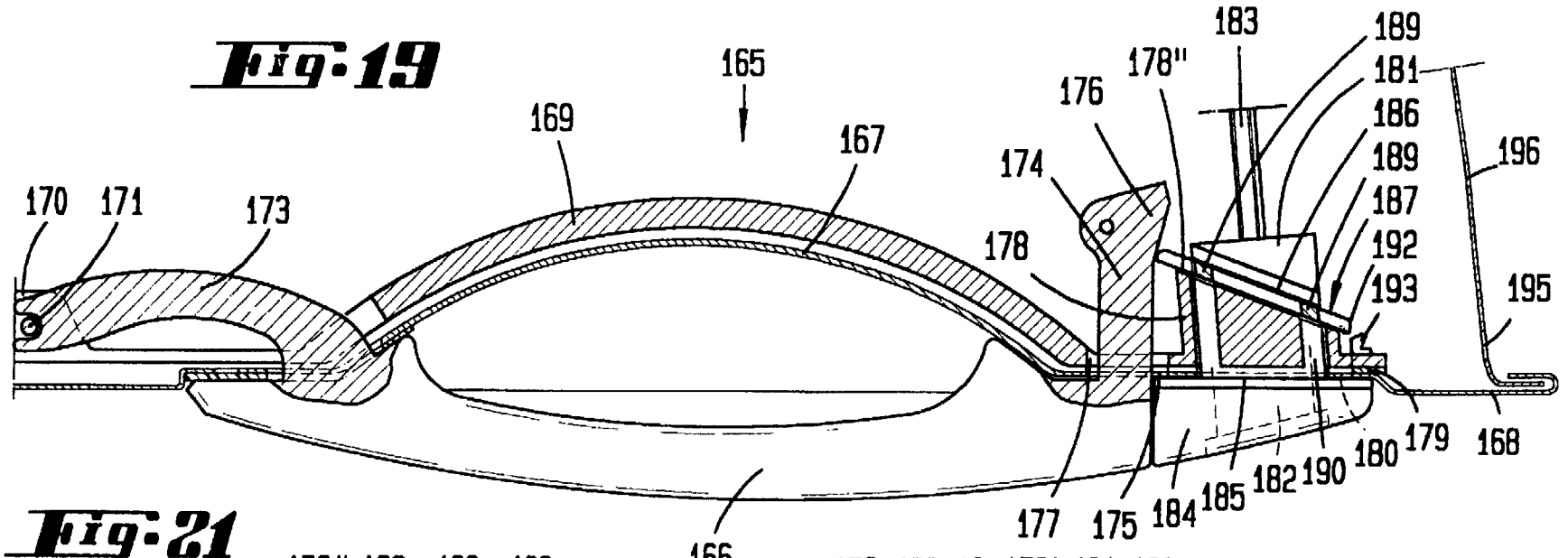
FIG. 19 is a longitudinal section through the handle fitting along the line XIX—XIX of FIG. 20, with the holding member still not brought into holding engagement.
Figure 20:
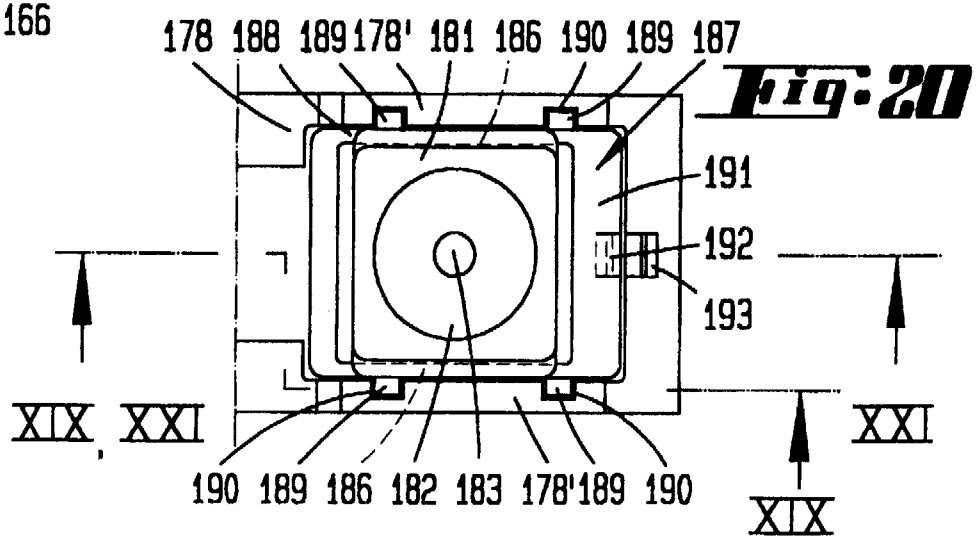
FIG. 20 is a showing similar to FIG. 16, in which the holding member is also in its release position.
Figure 21:
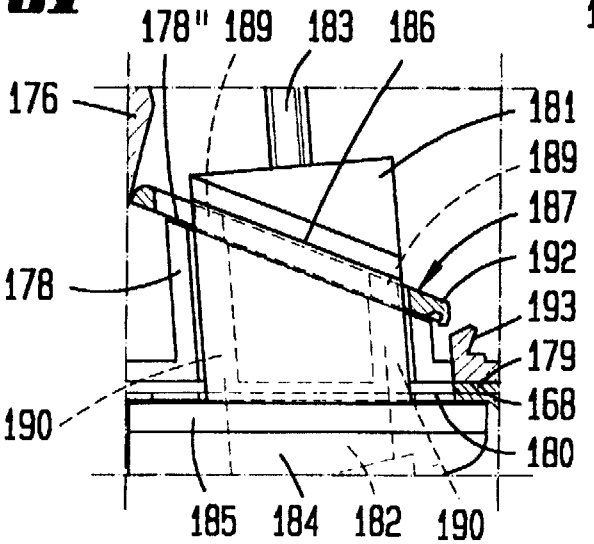
FIG. 21 is a section along the line XXI—XXI of FIG. 20.
Figure 22:
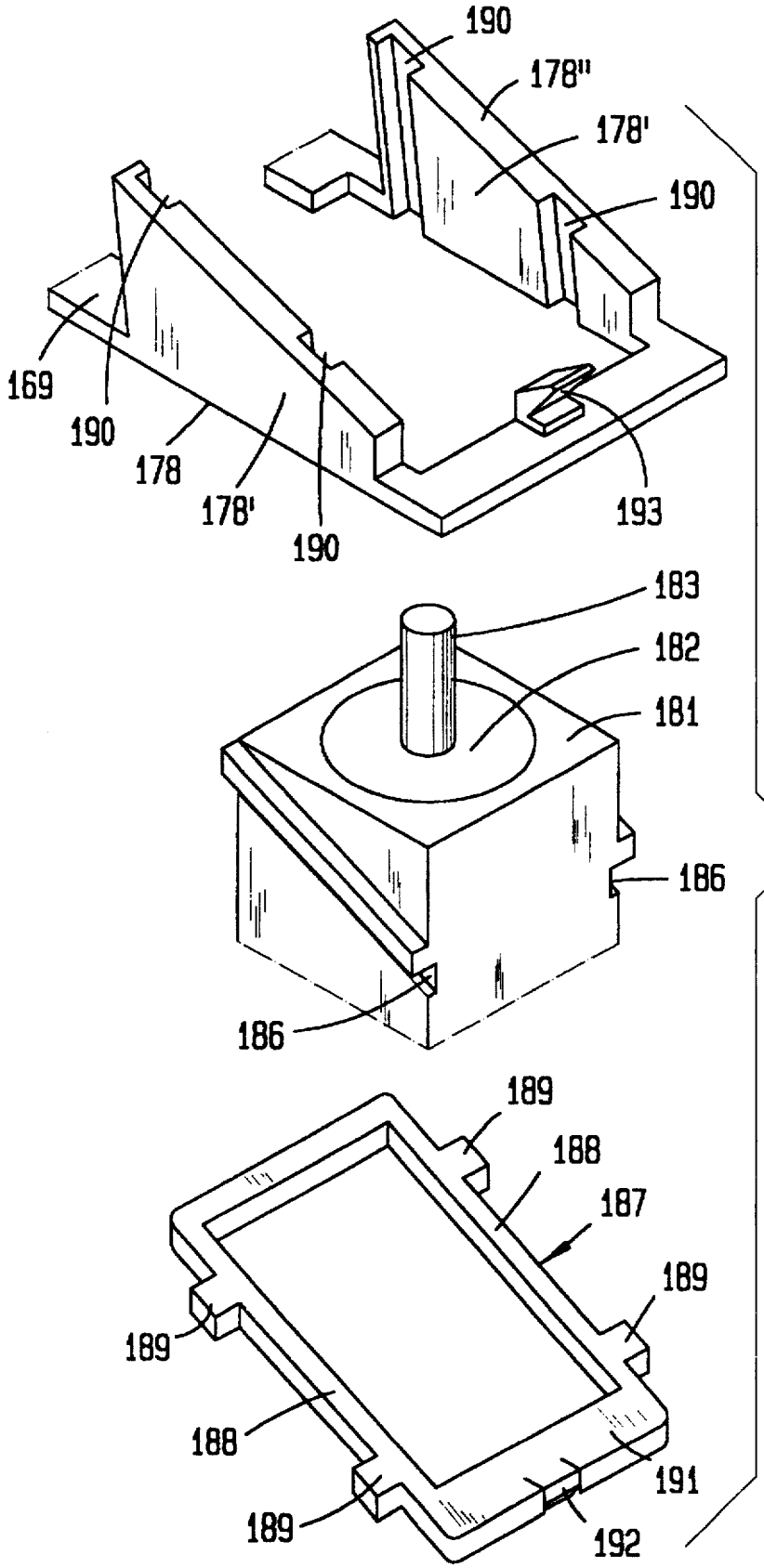
FIG. 22 is a perspective view of the parts to be brought into engagement in the region of the lock cylinder.

The housing 178 serves to receive an outer housing 181 which is approximately square in contour and which receives a lock cylinder 182 at its center. From the cylinder there extends a driver pin 183 which is connected for rotation with the cylinder core, not shown in detail. The outer housing 181 continues on the outer side of the door plate into a rosette 184 of approximately rectangular contour which is larger in surface than said housing and, in a manner not shown in the drawing, is covered with plastic and is aligned with the arcuate course of the actuating handle 166, as shown in FIG. 19. The rosette 184 lies on the outer plate 168 of the door with the interposing of a sealing collar 185.

The housing 181 bears, in two parallelly extending grooves 186 which descend obliquely towards the end of the handle fitting 165, a holding member 187 of frame shape. From the two opposite longitudinal arms 188 of the holding member 187 there extend in each case two support projections 189, arranged one behind the other, for which the lengthwise arms 178' of the housing 178 form inner-side slots 190 extending in the insertion direction of the outer housing 181. The positioning of the grooves 186 or the holding part 187 is such that, after insertion of the outer housing 181, the obliquely extending front edge 178" there of the housing 178 extends closely below the holding member 187.

The front transverse arm 191 which connects the two lengthwise arms 188 bears, cut therefrom, a spring tongue 192 having at its end a hook 192' which, in mounted position of the handle fitting 165, engages behind a locking step 193 of the handle fitting 165. The locking step 193 is formed by an extension arm of the housing 178 at the end of the holding cap 169 which is directed door inwards. Instead of a tongue 192 produced by cutting, a protruding tongue could also be present.

The opening enclosed by the housing 178 is so selected that its contour permits the insertion of the holding part 187 with lock cylinder 182. This is also true of the door recess 180.

Another sealing collar 194 is associated with the opening 172. Such a sealing collar is known. For this reason, it will not be described in detail.

Figure 18:
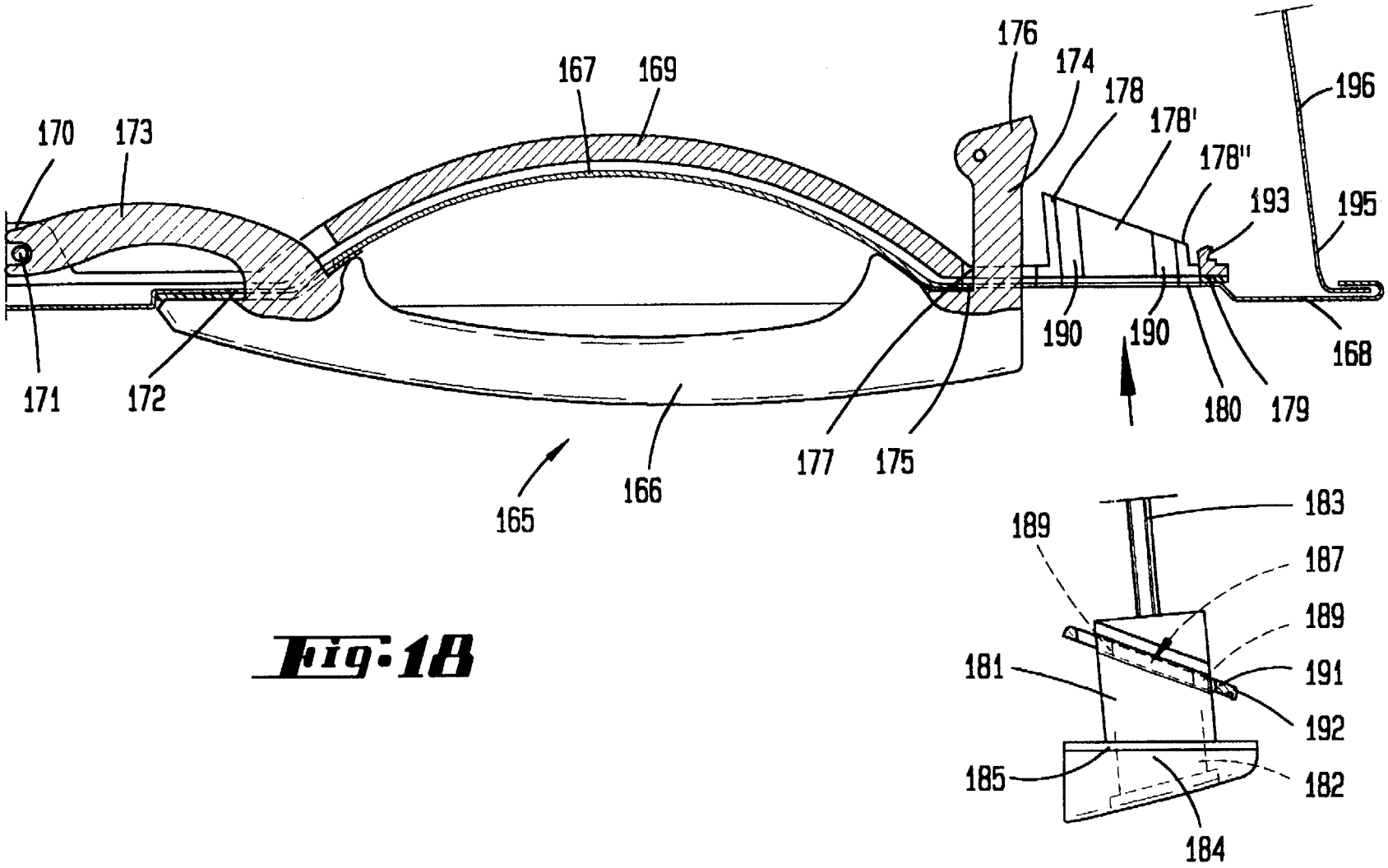
FIG. 18 is a longitudinal section similar to FIG. 15, but before insertion of the lock cylinder.

The mounting of the handle fitting 165 is effected as follows: First of all, the holding cap 169 is inserted, followed by the actuating handle 166, as shown in FIG. 18. The outer housing 188 which bears the lock cylinder 182 and receives the holding part 187 in its grooves 186 is now fed as shown in FIG. 18. The holding member 187 is so displaced that the supporting projections 189 are aligned with the slots 190 of the housing 178, so that the structural unit consisting of holding part 187, outer housing 181, and rosette 184 can be inserted in the direction indicated by the arrow in FIG. 18. During the insertion, the support projections 189 travel through the slots 190. In the stop-limited inserted position, the holding part 187 then extends on the other side of the inner end edge 178" of the housing 178; see FIGS. 19 and 21. If the first displacement of the actuating handle 166 into the position shown in FIG. 15 now takes place, then the head 176 of the actuating handle 166 strikes against the slide-like holding part 187 and displaces it. The supporting projections 189 come in front of the facing end side 178" of the housing 178, while the tongue 192 comes into detent engagement with the locking step 193 and thus fixes the displaced position of the holding part 192. In this way, the handle fitting 169 is fastened with the lock cylinder 182 to the door 102' of the motor vehicle. Removal of the handle fitting can be effected only when the door is open. Then, a tool-insertion opening 195 on the cup 196 extending from the outer plate 168 of the door is accessible. A screwdriver, for instance, can be inserted through the insertion opening 195, it eliminating the detent engagement between the holding part 187 and the locking step 193.

Figure 24:
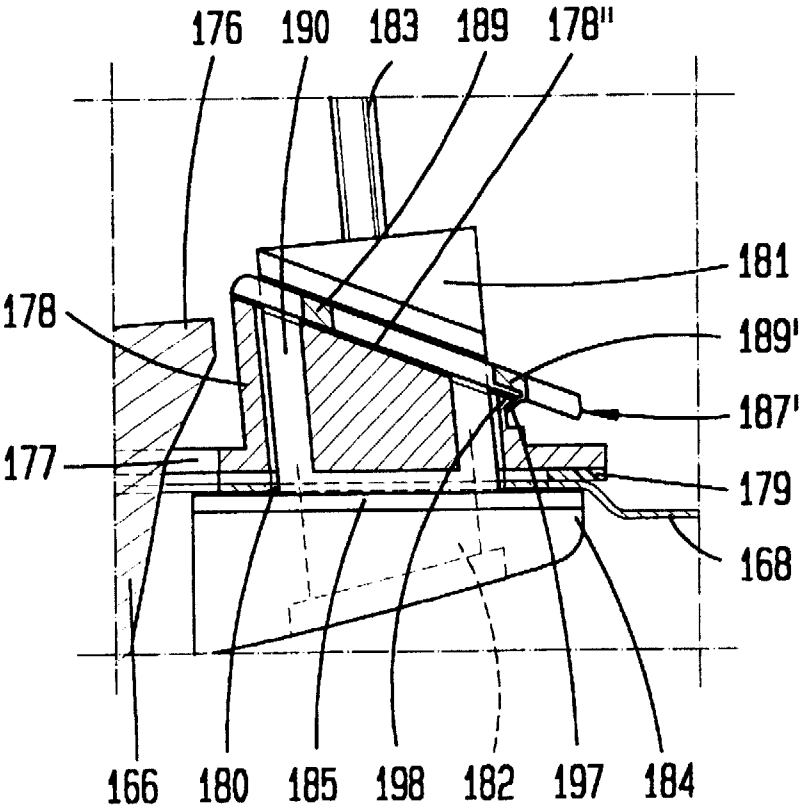
FIG. 24 is a showing following FIG. 23, in which the holding member is brought into the held position.
Figure 23:
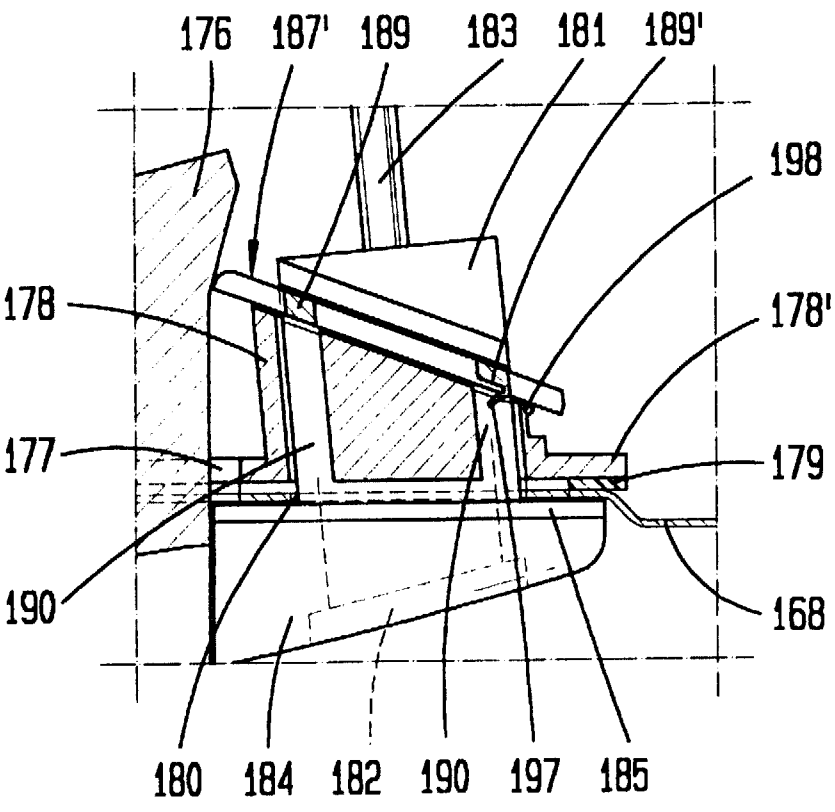
FIG. 23 is a section corresponding to FIG. 21, with holding member in the release position, in the case of the fourth embodiment.

In accordance with the fourth embodiment, shown in FIGS. 23 and 24, a modified detent engagement has been selected. For this purpose, one of the front supporting projections 189' has been shaped differently. It forms a resilient tongue 197 which cooperates with a modified locking step 198 of the handle cap 169 or its housing 178'. FIG. 23 shows the release position of the holding part 187', while FIG. 24 shows the position of the holding part 187' which results after the first displacement of the actuating handle 166. The tongue 197 of the holding part 187 then engages behind the locking step 198. With such a version, a tongue can be dispensed with on the front transverse arm of the holding part 187'.

We claim:

1. A handle fitting comprising a displaceable actuating handle and a holding member;

wherein the fitting can be inserted into an opening in a door, in particular the door of a motor vehicle, and be fastened by means of the holding member;

the fitting has a release position permitting insertion of the fitting into the opening, and a holding position for retaining the fitting in the opening, the retaining of the fitting in the door opening being accomplished by a gripping of an edge of the door opening upon insertion of the fitting in the door opening;

the holding member is movable, from the release position into the holding position by a sliding over the door opening in response to a displacement of the actuating handle, and the holding member remains in the holding position upon subsequent movement of the actuating handle.

2. A handle fitting according to claim 1, further comprising a tool insertion opening for receiving a tool, the tool insertion opening facing the holding member and being located, upon insertion of the fitting into the door, on an inner side of the door, wherein the tool serves, upon insertion into the tool insertion opening, for moving the holding member back into the release position.

3. A handle fitting according to claim 1, further comprising detent means for securing the holding member in the holding position.

4. A handle fitting according to claim 1, further comprising a handle trough facing outwardly from and in front of the door upon insertion of the fitting into the door, the actuating handle being located in the trough;

a swing shaft located adjacent an edge of the trough and connecting with the actuation handle to enable a pivoting of said actuation handle relative to the fitting;

wherein the holding member is configured as a slide which surrounds a rear surface of the handle trough and is displaceable transversely to the swing shaft of the actuating handle, one end of which slide passes, upon an angling-in of the handle fitting relative to the door opening, into engagement behind an outer plate of the door while the other end thereof passes by displacement of the slide into the holding position, in such a manner that both said ends of the slide assume a position engaged behind the door outer plate.

5. A handle fitting according to claim 4, further comprising at least one projection, firmly attached to the swing shaft, for urging the displacement of the slide into the holding position upon the pivoting of the actuating handle.

6. A handle fitting according to claim 4, wherein ends of the slide rest under tension against a rear surface of the outer plate of the door.

7. A handle fitting according to claim 4, further comprising a detent projection extending from a back side of the handle trough to enable relative motion between the detent projection and the slide during translation of the slide;

wherein the slide has a slide-side tongue and a central opening into which the slide-side tongue extends for cooperation with the detent projection which has gable bevels.

8. A handle fitting according to claim 1, wherein the door has an outer plate, the fitting further comprising a handle trough facing outwardly from and in front of the door upon insertion of the fitting into the door, the actuating handle being located in the trough, the fitting further comprising holding projections;

wherein the holding member is developed as a one-arm swing lever which rests on the rear surface of the handle trough of the handle fitting and which, by the holding projections, engages behind the rear of the outer plate of the door in the holding position.

9. A handle fitting according to claim 8, wherein the actuating handle has a stop member, the fitting further comprising a drive projection arranged opposite the holding projections, and which lies within the region of swing of the stop member of the actuating handle, the stop member being arranged on the inner side of the door.

10. A handle fitting according to claim 8, wherein the door opening is located in the door outer plate, the fitting further comprising a handle-fitting front plate located on an outside of the door outer plate and covering a perimeter of the door opening upon insertion of the fitting into the door opening;

handle-trough-side extension arms rigidly secured to the trough:

an insertion slot formed between the handle-fitting front plate and handle-trough-side extension arms for enabling emplacement of the handle fitting within the door opening of the door outer plate and in position opposite the holding projections.

11. A handle fitting according to claim 8, further comprising means for positioning the swing lever behind the trough, said positioning means permitting a sliding of said swing lever relative to said trough;

wherein a sliding movement of the swing lever carries the projections to a position of detent engagement with the door outer plate in a holding position of the swing lever.

12. A handle fitting according to claim 8, further comprising arcuate slot guides disposed within the swing lever for guiding the swing lever during a movement relative to the trough.

13. A handle fitting according to claim 8, further comprising a lock cylinder, and wherein the handle fitting and/or its lock cylinder is fixed in position by the holding member.

14. A handle fitting according to claim 13, wherein the holding member enters into a blocking partial surrounding of the lock cylinder.

15. A handle fitting according to claim 13, wherein the holding member is movably borne by the lock cylinder.

16. A handle fitting according to claim 13, wherein the actuation handle has a handle fitting including a projection head of the actuating handle, the projection head being movable upon movement of the actuating handle within a region of movement; and the holding member can be inserted, together with the lock cylinder, into the handle fitting in such a manner that the holding member lies within the region of movement of a projection of the actuating handle.

17. A handle fitting according to claim 15, wherein the holding member associated with the lock cylinder can be pushed through an opening in the handle fitting.

18. A handle fitting according to claim 16, wherein the holding member has lateral supporting projections which pass through insertion slots and, in the position displaced by the actuating handle, rest on shoulders of the handle fitting.

19. A handle fitting according to claim 16, wherein the handle fitting has a passage cross section with a slot;

the handle fitting has a locking step; and the holding member has a deflectable tongue which can be introduced through the slot in the passage cross section to engage in position of the holding member displaced by the actuating handle, behind the locking step of the handle fitting.

20. A handle fitting according to claim 19, wherein the tongue has a detent position for securing the handle fitting to the door;

the door has an insertion place for receipt of a tool; and the tongue can be bent out of its detent position by the tool upon insertion of the tool into the door.

* * * * *